US005180022A

United States Patent [19]

Brady

[11] Patent Number: 5,180,022

[45] Date of Patent: Jan. 19, 1993

[54] ROTARY MINING TOOLS

[76] Inventor: William J. Brady, 1767 Wishingwell Dr., Creve Coeur, Mo. 63141

[21] Appl. No.: 704,885

[22] Filed: May 23, 1991

[51] Int. Cl.[5] ..... E21B 10/54

[52] U.S. Cl. ..... 175/430; 175/421; 175/431; 175/432

[58] Field of Search ..... 175/329, 410, 379, 385, 175/421

[56] References Cited

U.S. PATENT DOCUMENTS

| | | | |
|---|---|---|---|
| D. 265,205 | 6/1982 | Munson | D15/139 |
| D. 324,527 | 3/1992 | Slutz | D15/139 |
| 2,578,593 | 12/1951 | Phipps | 175/421 X |
| 2,614,814 | 10/1952 | Jones et al. | 175/421 X |
| 2,650,071 | 8/1953 | Rassieur | 175/421 X |
| 2,740,611 | 4/1956 | Bowen | 175/421 X |
| 2,930,588 | 3/1960 | Lord | 175/421 X |
| 4,098,362 | 7/1978 | Bonnice | 175/329 |
| 4,241,798 | 11/1982 | Jones | 175/329 |
| 4,303,136 | 12/1981 | Ball | 175/329 |
| 4,333,540 | 6/1982 | Daniels et al. | 175/329 |
| 4,352,400 | 10/1982 | Grappendorf et al. | 175/330 |
| 4,359,335 | 11/1982 | Garner | 75/208 |
| 4,440,247 | 4/1984 | Sartor | 175/393 |
| 4,511,006 | 4/1985 | Grainger | 175/57 |
| 4,525,178 | 6/1985 | Hall | 51/309 |
| 4,570,726 | 2/1986 | Hall | 175/410 |
| 4,602,691 | 7/1986 | Weaver | 175/329 |
| 4,604,106 | 8/1986 | Hall et al. | 175/410 X |
| 4,682,987 | 7/1987 | Brady et al. | 51/293 |
| 4,694,918 | 9/1987 | Hall | 175/329 |
| 4,751,972 | 6/1988 | Jones et al. | 175/329 |
| 4,776,241 | 10/1988 | Pollington | 76/108 R |
| 4,819,748 | 4/1989 | Truscott | 175/410 |
| 4,858,707 | 8/1989 | Jones et al. | 175/329 |
| 4,913,244 | 4/1990 | Trujillo | 175/65 |
| 4,932,484 | 6/1990 | Warren et al. | 175/329 |
| 4,989,578 | 2/1991 | Lebourg | 125/23 |
| 5,025,874 | 6/1991 | Barr et al. | 175/329 |

FOREIGN PATENT DOCUMENTS

| | | | |
|---|---|---|---|
| 2205594 | 1/1973 | Fed. Rep. of Germany | 175/421 |
| 516813 | 9/1976 | U.S.S.R. | 175/421 |
| 2115460 | 9/1983 | United Kingdom | 175/329 |

*Primary Examiner*—Hoang C. Dang
*Attorney, Agent, or Firm*—Richard G. Heywood

[57] ABSTRACT

A rotary mining tool having a steel body adapted to be driven axially and turned in a rotational arc relative to its axis and being provided with a hardened wear surface with a cutting edge adapted for cutting engagement with a work area under the axial thrust of said tool body, the wear surface and cutting edge being constructed and arranged with a negative rake angle and a negative skew angle to position the wear surface for such cutting engagement under substantially total compression to thereby minimize tensile shear forces that would tend to break or crack the hardened wear surface.

14 Claims, 4 Drawing Sheets

FIG. 3A.
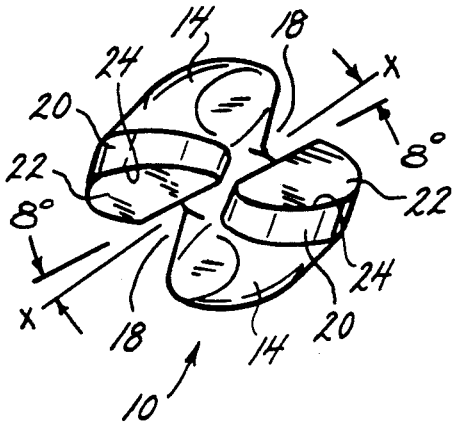
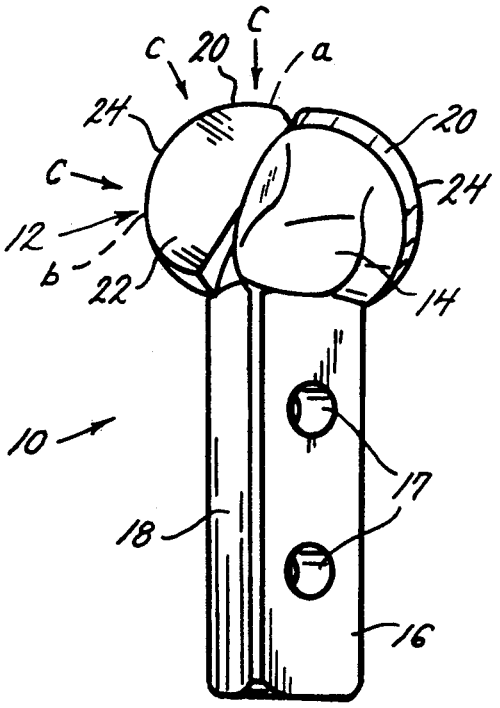
FIG. 3B.
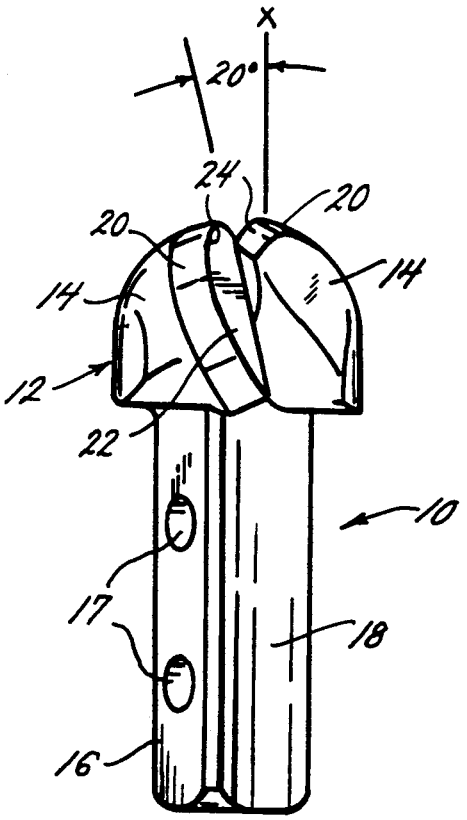
FIG. 3C.

FIG. 4A.
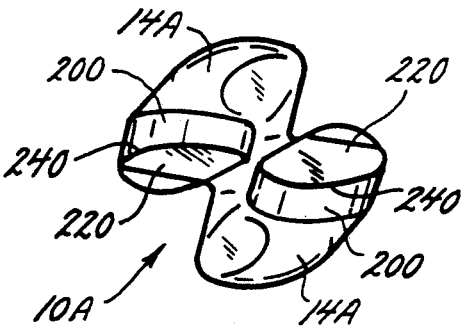
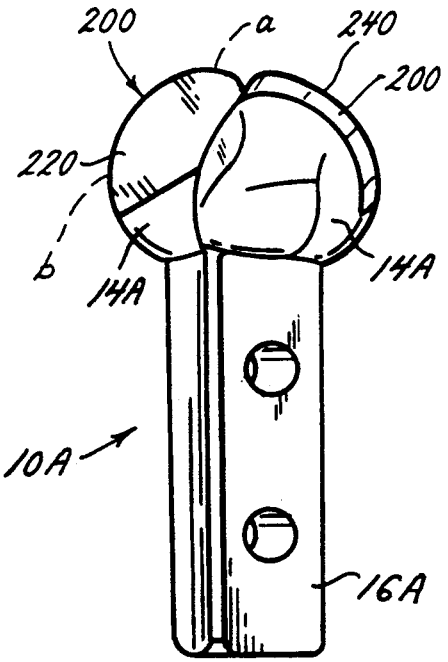
FIG. 4B.
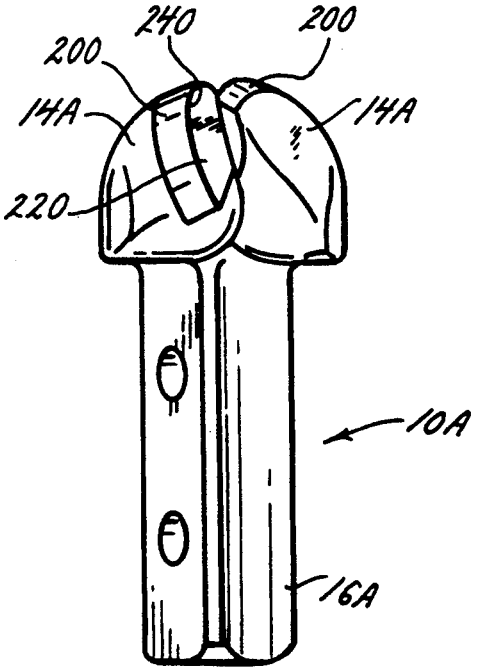
FIG. 4C.

FIG. 5A.
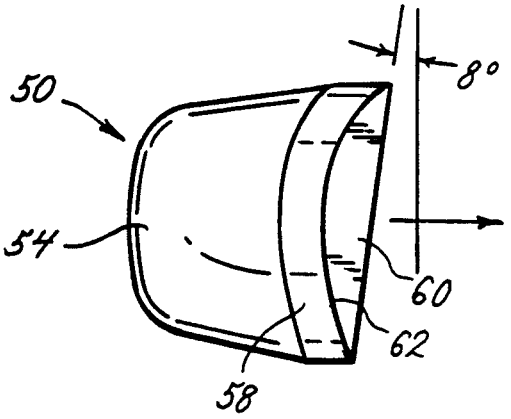
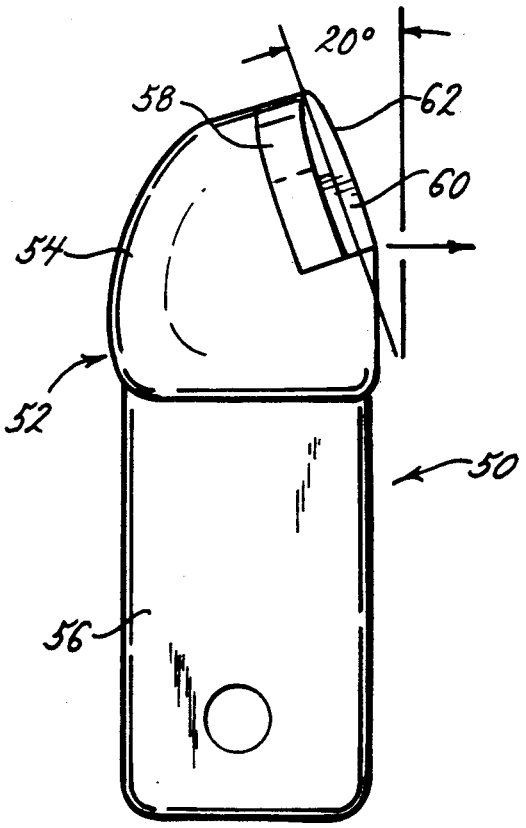
FIG. 5B.

ROTARY MINING TOOLS

BACKGROUND OF THE INVENTION

1. Field of the Invention

This invention relates generally to industrial, mining and construction tools, and more specifically to improvements in rotary drag bits and the like for boring, drilling and coring operations.

As used in the following disclosure and claims, the term "polycrystalline diamond" and its abbreviation "PCD" refers to a material formed of individual diamond crystals fused or sintered by intercrystalline bonding under high pressure and temperature into a predetermined layer or shape. The PCD material is usually permanently bonded to a substrate of tungsten carbide in a cobalt binder or like carbide matrix, also known in the art as "precemented carbide". Also, as used herein, the term "high density ceramic" or its abbreviation "HDC" refers to a mining tool having an insert embodying a PCD layer.

2. Prior Art

In the past rotary drilling and coring tools, as used in mining and construction, have been constructed with hardened drill bit cutting heads, and traditionally with sintered carbide inserts to prolong the operative life of the tool. Typical cutting tools may use a single or continuous cutting surface or edge, but frequently employ a plurality of discrete cutting elements or bits either sequentially and angularly arranged on a wheel, caisson or other continuous carrier or otherwise disposed in a predetermined sequence or pattern on a rotary bit or auger of some type. A typical class of heavy duty cutting tools, to which the present invention is particularly applicable involves industrial mining and construction equipment of rotary drag type. This class includes rotary roof bits, longwall radial bits, auger drill bits, undercutter bits, core barrel bits, face drill bits, and two-wing, three-wing and four-wing rotary drag bits—all of which are readily identifiable to those in the mining field.

A principal problem encountered in all of these prior art tools is the rapid wear and high cost of replacement along with machine down-time. This rapid tool wear and breakage, in part due to higher speed equipment and heavier impact forces and tensile stress, has led toward tool redesign with some larger, carbide insert or drilling tip configurations—which in turn has generally resulted in higher dust levels and increased potential ignition dangers contrary to mining safety regulations.

It is believed that a primary and inherent contributing factor in tool wear and breakage heretofore has been the conventional design configuration of such tool bits. Typically, substantially all prior tools have been constructed with a positive to zero rake angle thereby presenting a leading cutting edge point and trailing face that operate with a plow-type action and being subjected to high-point shear forces and tensile stress and drag. The typical positive angularity of cutting edge/face design produces rapid wear and failure, even in the tougher bits using tungsten carbide inserts and the like.

More recently, some substantial advances have been made in harder, tougher compositions for bit inserts. U.S. Pat. No(s). 4,525,178; 4,570,726; 4,604,106 and 4,694,918 disclose some of the basic underlying technology pertaining to such compositions and methods of making PCD materials proposed for use in various oil field drilling and mining operations as well as other machining operations. In particular, U.S. Pat. No. 4,570,726 discloses special insert shapes for drag-type rotary drill bits and suggests a tool having a working surface positioned at a slight negative angle from the perpendicular with respect to the material contacted. In fact, the '726 patent teaches away from the planar-type of working surfaces of both the prior art and the present invention, and discloses specially designed curved face insert configurations for obviating the backup or build-up of loosened material against the working surface. Another patent—U.S. Pat. No. 4,303,136 shows a series of drag bits having diamond surface layers carried on tungsten carbide bodies at a substantial negative rake angle, but this patent relates primarily to the orientation of the working face to hydraulic fluid passages for carrying off the loosened material.

SUMMARY OF THE INVENTION

The present invention is embodied in a rotary mining tool or the like having a body adapted to be energized axially and turned rotationally, and having a working wear surface with a cutting edge and being constructed and arranged for cutting engagement with a work area under substantially total compression to thereby substantially eliminate tensile shear forces.

It is an object of the present invention, therefore, to provide a rotary mining tool characterized by increased wear resistance and tool life; to provide a rotary mining tool configured to be substantially in compression during mining operations; to provide a rotary mining tool designed such that tensile forces acting on the cutting edges and surfaces of the tool during operation are minimized; to provide a rotary mining tool with the cutting edge and proximate surfaces designed so that loosened material is moved away from the cutting edge during operation; to provide a rotary mining tool which is self-sharpening due to a minor spalling action at the cutting edge without resulting in substantial wear and breakage; to provide a rotary mining tool characterized by a negative rake angle and a negative skew angle; to provide a rotary mining tool characterized by a negative rake angle which optimizes the self-sharpening action on the cutting edge; to provide a rotary mining tool which employs polycrystalline diamond/tungsten carbide inserts; to provide a rotary mining tool design adaptable for single face and multiple wing tool constructions; to provide a rotary mining tool having an increased effective cutting surface range; to provide a rotary mining tool which combines a tempered steel tool body and a composite insert of cemented tungsten carbide and polycrystalline diamond. These and still other objects and advantages will become more apparent from the detailed description which follows.

BRIEF DESCRIPTION OF THE DRAWINGS

In the accompanying drawings which form a part of the specification and wherein like numerals refer to like parts wherever they occur:

FIG. 3A is a top plan view of a preferred embodiment of a rotary drag bit of the invention;

FIG. 3B is a side elevational view of the tool of FIG. 3A;

FIG. 3C is another side elevational view of the tool of FIG. 3A as rotated 90° from the position of FIGS. 3A and 3B;

FIGS. 4A-4C are views similar to FIGS. 3A-3C showing a modified form of the preferred embodiment;

FIG. 5A is a top plan view of another embodiment of a rotary drag bit of the invention; and FIG. 5B is a side elevational view of the FIG. 5A tool embodiment;

BRIEF DESCRIPTION OF THE PREFERRED EMBODIMENTS

The present invention is generally applicable to all types of heavy duty cutting tools of the rotary drag type utilized in industrial mining and construction fields. This class of tools includes rotary roof bits, longwall radial bits, auger drill bits, undercutter bits, core barrel bits, face drill bits and multiple wing rotary drag bits, as will be apparent to skilled persons, particularly in coal and hard rock mining fields. In a typical operation involving rotary drag bits, a roof drill bit or longwall bit is applied to coal or hard rock surfaces under a driving force in the range of 5000 to 13,000 psi and rotated in the range of about 80 to 800 rpm, depending upon the application and machine design, to produce the drilling or boring result desired. However, in the past the resulting performance levels of conventional rotary drag tools has been accepted as normal only because there was no better tool available. FIGS. 1A-1C and FIGS. 2A-2C are presented to show two typical prior art tools and provide a comparison basis for better understanding the present invention.

Figure 1B:
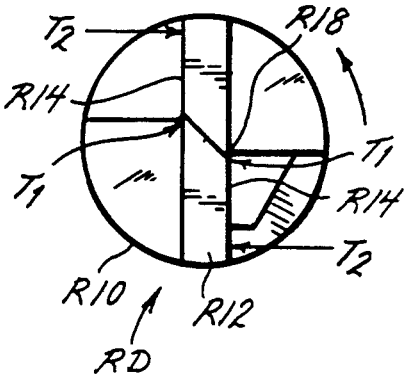
PRIOR ART FIG. 1B.
FIG. 1B is a top plan view looking downwardly on the prior art tool of FIG. 1A.
Figure 1A:
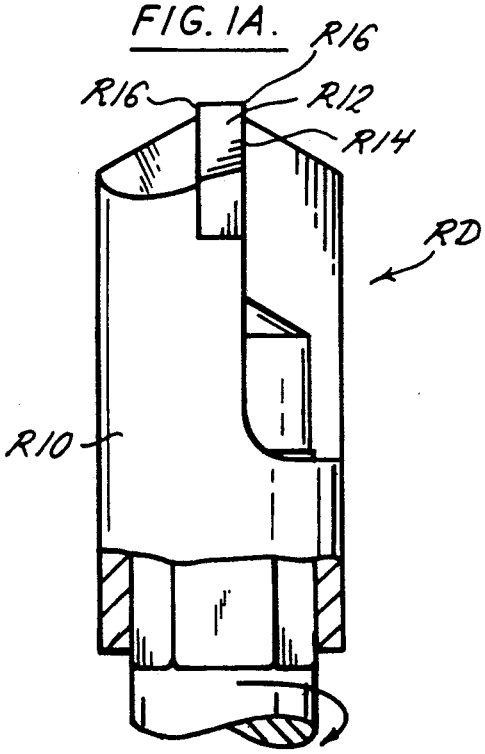
FIG. 1A is a side elevational view of a typical prior art tool illustrated for comparison purposes with the present invention.
Figure 1C:
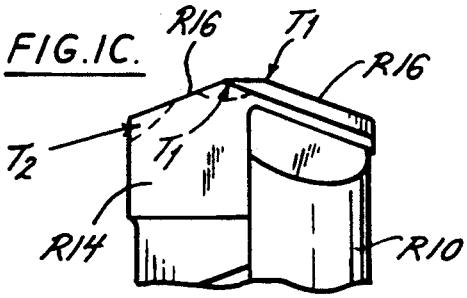
FIG. 1C is a side elevational view rotated 90° from the FIG. 1 position.

FIGS. 1A-1C show a typical prior art roof drill bit RD having a cylindrical bit body R10 with a single cutting head insert R12 typically formed of tungsten carbide. The insert R12 extends diametrically across the body R10 and forms oppositely facing insert wear surfaces R14 with cutting edges R16. The cutting edges R16 and downwardly extending wear surfaces R14 have rake angles at zero degrees; that is, both faces lie in vertically disposed (and parallel) planes relative to the axis of the bit body R12, and are substantially perpendicular or normal to the direction of rotation of the bit body 10 (FIG. 1B). As shown best in FIG. 1C, the cutting edges R16 of insert R12 are sloped or angled outwardly or upwardly to define a high point tip R18 for starting the bore or entry hole in the mine material. Clearly the prior art tool RD of FIGS. 1A-1C is subjected to substantial tensile stress due to the zero degree (0°) rake angles of flat surfaces R14 at the cutting edges R16 being forced against the work area and the angularity of the insert corners (at $T_1$ and $T_2$) being subjected to high shear stress and drag in the adjacent surface areas delineated by broken lines thereby causing rapid wear and frequently resulting in premature insert breakage and tool failure. As will also become more apparent hereinafter, the angular design of insert R12 also provides a straight line cutting edge R16 that is limited in scope or range to about two-thirds (⅔) of the cutting range of a preferred tool of the present invention.

Figure 2B:
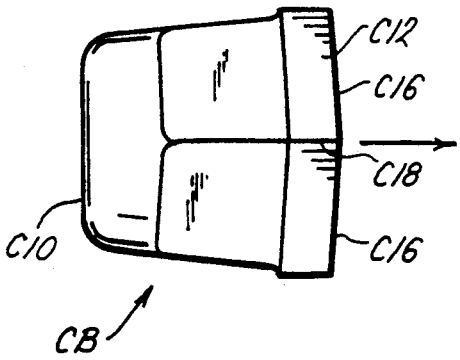
FIG. 2B is a plan view looking downwardly on the tool of FIG. 2A.
Figure 2A:
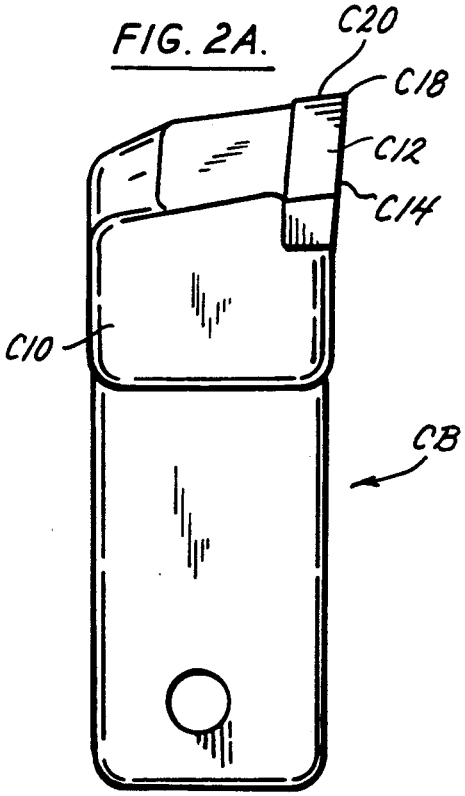
FIG. 2A is a side elevational view of another prior art tool illustrated for comparison purposes.
Figure 2C:
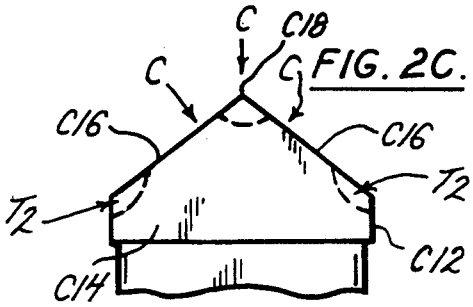
FIG. 2C is a diagrammatic representation of the compression and tension forces on the FIG. 2A tool.

FIGS. 2A-2C show a typical prior art coring bit CB having a steel body C10 forming an enlarged supporting mass or pillow block behind a cutting head insert C12 of tungsten carbide. The insert C12 provides a single, forwardly facing insert surface C14 with upwardly sloping cutting edges C16 defining a central high point entry tip C18. The cutting tool CB has a positive rake angle (FIG. 2A); that is, the entry tip C18 defines the initial entry point for forming the bore and the wear surface C14 is undercut and lies in a plane that slants downwardly and rearwardly from the tip C18 relative to both the axis and direction of rotation. This prior art tool CB, as with tool RD, is subject to high tensile stress and drag resulting in rapid dulling and breakage. It is clear that the high point tip C18 and entire cutting edge C16 on each side is in full tension T due to shear forces or torque, and that only minimum compressive forces C are exerted vertically downwardly on the upper insert wall portions C20 located immediately behind the cutting edges C16. In addition, the angularity of this rectangular insert design is limiting upon the effective cutting edge range, making it approximately two-thirds of that of a preferred tool of the present invention.

The prior art tools having positive to zero degree rake angles, of which tool RD of FIG. 1A-C and tool CB of FIG. 2A-C are merely representative, have cutting edges and adjacent wear surfaces that work with a plowing type of action and are subjected to high tensile stress at the high driving forces and rotational speeds required to work into coal and hard rock surfaces. Clearly the cutting edges of such tools must be designed to cut clearance for the remaining tool bit structure, and at positive to zero rake angles there is little, if any, structural supporting mass behind the insert cutting edges to reinforce and minimize rapid wear and breakage. Thus, substantially the only compressive forces tending to push and hold the cutting edges on the insert and underlying tool body, are the vertical or axial forces resultant from the driving entry forces applying the bit to the work surface.

Referring now to FIGS. 3A-3C, a preferred embodiment of the invention is illustrated in the form of a roof drill bit 10 as one of the class or type of rotary drag bits to which the invention pertains. The bit 10 has a tempered steel body 12 constructed and arranged with diametrically opposite dual pillow block heads 14 on a mounting shank 16 for removably securing the bit 10 to a drilling machine (not shown) in a well-known manner. Thus, the shank 16 has bolt holes 17 for attachment to a long rod drive steel (not shown) of the machine, and is provided with the usual water flutes 18 in the opposite elongated walls for channeling the hydraulic flushing fluids (i.e. mud) used for cooling and cleaning the cutting faces of the bit 10.

The roof drill bit 10 of FIGS. 3A-3C preferably utilizes a high density ceramic insert 20 on each of dual heads 14; this insert material having a "precemented carbide" base bonded onto the steel body mass and having a "polycrystalline diamond" layer fused thereon as a working wear surface 22. HCD inserts are made in the form of round discs of uniform thickness and, in the FIG. 3A-3C embodiment, one disc is then cut into two semi-round halfs to be applied to the oppositely facing steel body surfaces of the dual heads 14. As shown in FIG. 3B, the arcuate cutting edge 24 formed on the wear surface 22 has an entry point "a" and curves outwardly to point "b" to cut clearance for the tool body—a sweep of about 90°. As will be seen even more clearly in the modified embodiment of FIGS. 4A-4C to be described, the effective cutting edge 24 formed on the wear surface 22 of each insert 20 actually extends about 15° beyond both point "a" and point "b" to define an arc of approximately 120°. Thus, in comparison with the prior art tools of FIGS. 1A-1C and 2A-2C, the rotary tool bit 10 of the present invention has an effective cutting arc of at least 90° compared to prior art cutting edges equivalent to about 65° if curved on the same circumference. A feature of the present invention is the self-sharpening characteristic of the PCD cutting edges 24, and as this self-sharpening occurs due to resultant minor spalling wear during tool usage, the gauge cutting area is increased. Thus, the gauge cutting area expands to an effective cutting arc of about 120°.

The rotary drag bit 10 of the present invention is constructed and arranged to position its wear faces 22 and cutting edges 24 so as to be in substantially full compression during use. FIGS. 3A-3C show that the wear surfaces 22 have a negative rake angle and a negative skew angle, as compared with prior art tools having zero to positive rake angles and no skew. As shown in FIG. 3C, each wear surface 22 of tool bit 10 has a preferred negative rake angle of 20°, i.e. it lies in a plane that is laid back or open relative to the vertical axis of the tool and a plane "x—x" extending normal to the direction of rotation. It is believed that the operative range of negative rake angles useful in cutting tools of the present invention will be about 5° to 35° and, even more preferably, will be in the range of 15° to 20°. As shown in FIG. 3A, each wear surface 22 has a preferred negative skew angle of about 8° relative to the same vertical plane "x—x" extending across the axis of the tool and normal to the rotational arc thereof. The operative range of negative skew angles will be about 2° to 20° and, even more preferably, will be in the range of about 4° to 10°.

It will now be apparent that a rotary drag bit 10 or like mining tool having a cutting edge (24) and wear surface (22) disposed at a substantial negative rake angle in the range of 5° to 35° and a negative skew angle in the range of 2° to 20° will produce a radial auger-type cutting action rather than a plowing action. This negative rake and skew angle combination positions the wear surface 22 to engage and be opposed by the axial thrust of the drill bit 10 against the work surface thereby imparting substantially total compression across the entire wear surface of the insert 20 to firmly compress and maintain it against the body mass of the pillow block head 14 to which it is bonded. Thus, the tensile stress on the inserts is held to a minimum, and the additional benefit of the negative rake and skew angle configuration is that it results in a rotary drag tool having a continuous self-sharpening of the cutting edge 24. The cutting action of the edge 24 produces minor spalling or flaking away of minute PCD particles to achieve the self-sharpening, rather than dulling the cutting edge or resulting in breakage as occurs in prior art tools due to tensile forces.

Actual field tests of a prototype roof drill bit 10 of the FIG. 3A-3C design in comparison with a prior art tool RD of the FIG. 1A-1C design has established that the present invention constitutes a substantial improvement in the construction and performance of rotary drag bits. In a first test, the drill bit 10 with its PDC insert 20 and a prior tool RD with a tungsten carbide insert R12 were mounted on a New Fletcher double boom roof bolter machine and applied to drill four (4') foot holes in 22000-28000 PSI sandstone for anchoring resin roof bolts. The tool 10 of the present invention originally drilled five (5) of these holes and, although accidentally cracked by manual mishandling, continued to successfully drill fifteen (15) additional holes for a total of eighty (80') feet. The prior art tool RD could only drill one four (4') foot maximum before being dulled or broken.

A second test on the same equipment in the same mine was made using two (2) HDC bits 10 for drilling four (4') foot depth holes. One of these bits ("HDC-1") drilled 100 hundred holes of four foot depth (that is, 400 feet) and the second bit ("HDC-2") of the second test drilled 300 holes for a total of 1200 feet. A 70 hole time study of the HDC-1 bit was compared with 70 holes timed on the standard carbide bit RD. The HDC-1 bit had a penetration rate of 21-24 seconds per four foot hole with ¾ axial thrust of the machine, as compared with a penetration rate of 26-32 seconds with full machine thrust on the prior art tool RD. All standard tool bits RD in this test were new or reground on every four foot hole. At 280 feet, the HDC-1 bit was still penetrating at 21 seconds per hole and established the self-sharpening feature of the present invention. The conclusions reached in these tests are that tools of the present invention outperform conventional prior art tools by a ratio up to about 300:1, at penetration rates of 8% to 15% faster than new or reground conventional bits, and with 25% less thrust in all roof conditions thereby resulting in less wear on the drill steel and machine.

On the basis of the foregoing tests, it is clear that the dramatically improved performance of the roof bit (10) over existing standard roof bits (RD) presently used in the coal and hard rock mining fields establish the importance of the present invention.

Referring to FIGS. 4A-4C, a modified form of the preferred embodiment is illustrated. In this form, the roof drill bit 10A may have the same basic structure as the FIG. 3A-3C embodiment, except that the oppositely facing inserts 200 are formed by cutting a PCD insert disc (not shown) into three segments, each of which has an effective cutting edge 240 with a 120° arc. Thus, a thirty-three (33%) percent savings in HDC insert costs can be achieved without any substantial loss of performance. It is clear that the wear surface 220 of the FIG. 4A-4C tool embodiment has a negative rake angle in the range of 5° to 35°, and preferably about 20°; and also has a negative skew angle in the range of 2° to 20°, and preferably about 8°.

Referring to FIGS. 5A and 5B, another type of rotary drag bit 50 embodying the invention is an improvement over the prior art tool CB of FIGS. 2A-2C. This coring bit 50 includes a steel body 52 with an enlarged pillow block 54 on the end of shank 56. An HDC insert 58 is bonded to the supporting head 54 and has a wear surface 60 positioned at a negative rake angle in the range of 5° to 35° and a negative skew angle of 2° to 20°, both relative to a vertical plane extending normal to the direction of rotation of the tool 50. As shown, the preferred negative rake angle is 20°, and the preferred negative skew angle is 8°. The insert 58 is in the shape of a half-round disc thereby eliminating angular corners having the high tensile stresses of prior art tools, such as coring bit CB of FIGS. 2A-2C, and the arcuate cutting edge 62 has an effective sweep in the range of 120°-180°. It will be clear that the negative rake and skew angles together with the arcuate cutting edge 62 of this embodiment result in minimizing tensile stress, and the compressive forces applied against the wear surface 60 of the insert 58 during boring operations result in only minor spalling of the cutting edge 62 and the self-sharpening action thereof.

It is now apparent that the objects and advantages of the present invention over the prior art have been fully met. Changes and modifications to the disclosed forms of the invention will become apparent to those skilled in the mining tool art, and the invention is only limited to the scope of the appended claims.

What is claimed is:

1. A roof drill bit mining tool subject to rotary action and performing cutting functions of drilling and boring as for roof bolting operations in industrial mining and tunnel construction, said mining tool having a tempered steel body with dual oppositely facing support surfaces, and a high density ceramic insert bonded to each of said support surfaces, said high density ceramic insert being constructed and arranged with a polycrystalline diamond layer defining a substantially planar wear surface and having a self-sharpening outer cutting edge with a high entry point and an outer gauge-cutting margin thereon, said planar wear surface being positioned at a negative rake angle in the range of 5° to 35° and at a negative skew angle in the range of 4° to 10°, both relative to a plane extending normal to the direction of rotation of said mining tool, and the high entry point of each diamond layer initiating its cutting action substantially closer to the axis of rotation of said tool than to the outer gauge-cutting margin thereof, and said cutting edge of each diamond layer extending in a radial direction along a continuous arcuate path from an inner margin substantially at the tool axis to the outer gauge-cutting margin for tool clearance.

2. The mining tool according to claim 1, in which the negative rake angle of wear surface is in the range of 15° to 25°.

3. The mining tool of claim 1, in which said negative rake angle is about 20°.

4. The mining tool of claim 1, in which the negative skew angle is about 8°.

5. A roof drill bit comprising:

a bit body having a shank portion constructed and arranged for attachment to a drill column for rotation on a central axis and having a cutter head portion constructed and arranged for drilling and boring as in roof bolting operations in industrial mining and tunnel construction, said head portion having a pair of support surfaces oppositely oriented in the direction of rotation of said bit body; and a pair of cutter inserts each of which is rigidly bonded to one of the head portion support surfaces and includes a polycrystalline diamond layer defining an outer cutting edge and an adjacent, substantially planar wear surface extending therefrom;

the planar wear surface of each insert having a negative rake angle from a plane normal to the direction of rotation of said tool and also being positioned at a negative skew angle in the range of 4° to 10° relative to such plane; and said cutting edges of said pair of cutter inserts having outer gauge-cutting margins and high entry points located substantially closer to the rotational axis of the tool than to the gauge-cutting margins, and said cutting edges extending along arcuate paths substantially continuously from the rotational axis of the tool to said gauge-cutting margins.

6. The roof drill bit of claim 5, in which the negative skew angle is substantially 8°.

7. The roof drill bit according to claim 5, in which the negative rake angle of wear surface is in the range of 15° to 20°.

8. The roof drill bit of claim 3, in which said negative rake angle is substantially 20°.

9. The roof drill bit according to claim 5, in which the negative rake and skew angles of said wear surfaces and the arcuate cutting edges thereof are constructed and arranged for cutting engagement under substantially total compression to spread the shear forces along the cutting edges and thereby minimize any concentration of high point shear forces.

10. The roof drill bit of claim 9 in which said negative rake angle is in the range of 5° to 35°.

11. The roof drill bit of claim 9 in which said negative rake angle is substantially 20°.

12. The roof drill bit of claim 9, in which said negative skew angle is substantially 8°.

13. The roof drill bit according to claim 5, in which the negative rake and skew angles of said wear surfaces and arcuate cutting edges thereof are constructed and arranged for cutting engagement with the wear surfaces being positioned under substantially total compression to thereby minimize tensile shear forces that would tend to break or crack the cutter inserts.

14. The roof drill bit according to claim 5, in which the arcuate cutting edge has a cutting sweep in the range of 90° to 130°.

* * * * *

UNITED STATES PATENT AND TRADEMARK OFFICE

CERTIFICATE OF CORRECTION

PATENT NO. : 5,180,022

DATED : January 19, 1993

INVENTOR(S) : William J. Brady

It is certified that error appears in the above-identified patent and that said Letters Patent is hereby corrected as shown below:

Column 4, line 60, "HCD" should be --HDC--.

Column 6, line 7, before "maximum" insert --hole--.

Column 6, line 10, after "bits" delete --10--.

Column 7 (claim 3), line 40, "about" should be --substantially--.

Column 7 (claim 4), line 42, "about" should be --substantially--.

Column 8 (claim 7), line 24, "20°" should be --25°--.

Column 8 (claim 8), line 25, "claim 3" should be --claim 5--.

Signed and Sealed this

Fourteenth Day of December, 1993

*Attest:*

Bruce Lehman

BRUCE LEHMAN

*Attesting Officer*

*Commissioner of Patents and Trademarks*